US012312129B2

(12) United States Patent
Borse et al.

(10) Patent No.: US 12,312,129 B2
(45) **Date of Patent: *May 27, 2025**

(54) THERMOFORMED CLOSURE WITH OVERLAPPING TAB

(71) Applicants: Robert Joseph Borse, Plainfield, IL (US); Michael Rae Borse, Western Springs, IL (US); Joseph Jude Borse, Chicago, IL (US)

(72) Inventors: Robert Joseph Borse, Plainfield, IL (US); Michael Rae Borse, Western Springs, IL (US); Joseph Jude Borse, Chicago, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/078,570

(22) Filed: Dec. 9, 2022

(65) Prior Publication Data

US 2023/0103855 A1 Apr. 6, 2023

Related U.S. Application Data

(63) Continuation of application No. 16/727,284, filed on Dec. 26, 2019, now Pat. No. 11,542,070, and a continuation-in-part of application No. 16/232,459, filed on Dec. 26, 2018, now abandoned.

(51) Int. Cl.
*B65D 43/02* (2006.01)
*B65D 47/08* (2006.01)

(52) U.S. Cl.
CPC ..... *B65D 43/0208* (2013.01); *B65D 47/0847* (2013.01); *B65D 2251/1008* (2013.01); *B65D 2543/00046* (2013.01); *B65D 2543/00092* (2013.01); *B65D 2543/00296* (2013.01); *B65D 2543/00351* (2013.01); *B65D 2543/00555* (2013.01)

(58) Field of Classification Search
CPC ..... B65D 47/0823; B65D 43/0208
USPC ..... 220/254.3, 254.5, 254.7
See application file for complete search history.

(56) References Cited

U.S. PATENT DOCUMENTS 5,197,624 A * 3/1993 Dodaro ..... B65D 47/0833 220/269
5,490,609 A * 2/1996 Lane ..... B65D 47/0847 220/254.3
5,927,535 A 7/1999 Goth

* cited by examiner

*Primary Examiner* — Jeffrey R Allen
(74) *Attorney, Agent, or Firm* — McDonnell Boehnen Hulbert & Berghoff LLP

(57) ABSTRACT

An apparatus having a body portion and a tab coupled to the body portion via a hinge, wherein the tab comprises a first side edge and a second side edge, and further wherein the tab has a closed position covering an opening in the body and an open position where the opening is uncovered, wherein in the first condition the tab has a first width, and when the tab is in a second condition, the tab has been widened to a second width greater than the first width, and the tab has an outer radial edge that extends towards, but short of, the outer portion of the apparatus, and wherein a flat surface is positioned around the opening, and when the tab is in the second condition the side edges of the widened tab extend over the flat surface when the tab is in the closed position.

20 Claims, 12 Drawing Sheets

THERMOFORMED CLOSURE WITH OVERLAPPING TAB

CROSS REFERENCE TO RELATED APPLICATIONS

The present application is a continuation of U.S. application Ser. No. 16/727,284, filed Dec. 26, 2019, which is a continuation-in-part of U.S. application Ser. No. 16/232,459, filed Dec. 26, 2018. The entire contents of U.S. application Ser. Nos. 16/727,284 and 16/232,459 are incorporated by reference into the present application.

BACKGROUND OF THE INVENTION

The present invention relates to a closure, such as a lid, for a container, such as a cup. Lids are frequently used to maintain a temperature of a liquid as well as keep the liquid from spilling out of the cup. For example, it is common for restaurants and other establishments to serve drinks, such as coffee, in some type of disposable cup and include a lid to prevent spills and/or maintain the temperature of the drink. In some instances, thermoformed plastic, disposable lids are attached to a cup.

Existing lids of this type sometimes include tabs that can be removed or altered in a way in order for a patron or user to drink or sip the liquid inside through the lid itself. However, existing lids like this fail to provide a way to easily and efficiently close the tab of the lid. Moreover, some other existing lids may be made up of multiple components that must be assembled together. Such lids require extensive tooling and assembly processes before use.

As such, the present invention fulfills a need by providing a lid that includes components that provide the ability for a tab of the lid to be maintained in an open and closed position. Additionally, the tab that is formed as part of the lid as a single component, while still providing the functionality described herein. This is an improvement on the existing thermoformed plastic lids currently available.

SUMMARY

An example apparatus or device, for example a closure or lid, as well as related systems and methods of manufacturing such a lid, are described herein. The lid includes a body portion, a tab, and a flange portion. The body portion may be generally planar and circular in some embodiments. The body portion includes a first locking feature. In some examples, the first locking feature may be recessed into the body portion of the lid, or in other examples, the first locking feature may be extruded out of the lid. The locking feature may have a shape and configuration to mate with another corresponding locking feature. The tab of the lid is coupled to the body portion of the lid via a hinge. Additionally, the tab includes a plurality of edges and a second locking feature. The tab also has at least a closed position and an open position. In the open position, the second locking feature of the tab is coupled to the first locking feature of the body. The tab has a first condition and a second condition. In the first condition, the plurality of edges of the tab move from the closed position to the open position without interference with the flange portion. However, when in the second condition, at least one of the plurality of edges of the tab overlaps the flange portion such that the flange portion interferes with the movement of the tab from the closed position to the open position.

Within examples, the first condition may be considered the formed condition while the second condition may be considered the flattened or tooled condition. When in the first condition, the tab may include a middle body portion as well as a plurality of angled surfaces. A slope of the angled surfaces of the tab may be adjusted in the second condition when compared to the first condition.

An example method of manufacturing a lid is described as well. The method includes thermoforming a lid. The lid comprises a body portion, a tab portion, a hinge, and a flange portion. The hinge is between the tab portion and the body portion. The method also includes trimming the tab portion of the lid from the flange portion of the lid such that the tab portion moves relative the body portion via the hinge. Moreover, the method continues and includes, after trimming the tab portion, widening the tab portion such that the flange portion interferes with the movement of the tab portion when the tab portion moves from a closed position to an open position.

In some embodiments, the method may also include adjusting a slope of at least one of a plurality of edges of the tab portion of the lid. Additionally, within other examples, widening the tab portion may include heating and/or flattening the tab portion of lid.

These, as well as other aspects, advantages, and alternatives, will become apparent to those of ordinary skill in the art by reading the following detailed description, with reference where appropriate to the accompanying drawings.

DETAILED DESCRIPTION

Example devices, systems, and methods are described herein. The words "example," "exemplary," and "illustrative" are used herein to mean "serving as an example, instance, or illustration." Any embodiment or feature described herein as being an "example," being "exemplary," or being "illustrative" is not necessarily to be construed as preferred or advantageous over other embodiments or features. The example embodiments described herein are not meant to be limiting. It will be readily understood that the aspects of the present disclosure, as generally described herein, and illustrated in the figures, can be arranged, substituted, combined, separated, and designed in a wide variety of different configurations, all of which are explicitly contemplated herein.

Existing container lids may include a tab that is torn, flipped, or otherwise adjusted such that a liquid inside is allowed to flow through a cavity created in the lid where the tab used to be. However, lids with such tabs generally do not provide an effective means for closing the tab after opening without including additional pieces that require separate forming adding cost and time to the manufacturing process.

To efficiently and cost-effectively provide closing or clasping functionality to disposable thermoformed plastic lids, example lids and methods of manufacturing thereof are described herein. Among the various examples, a tab of a thermoformed lid is lightly tooled via heat and/or flattening after forming such that the tab or another portion of the lid, singularly formed as part of the lid, is widened such that the components interfere with one another such that the tab may be maintained in a closed position. This provides economies of production as a one piece tab and lid with overlap that is adaptable to various types of storage and container products.

Figure 1:
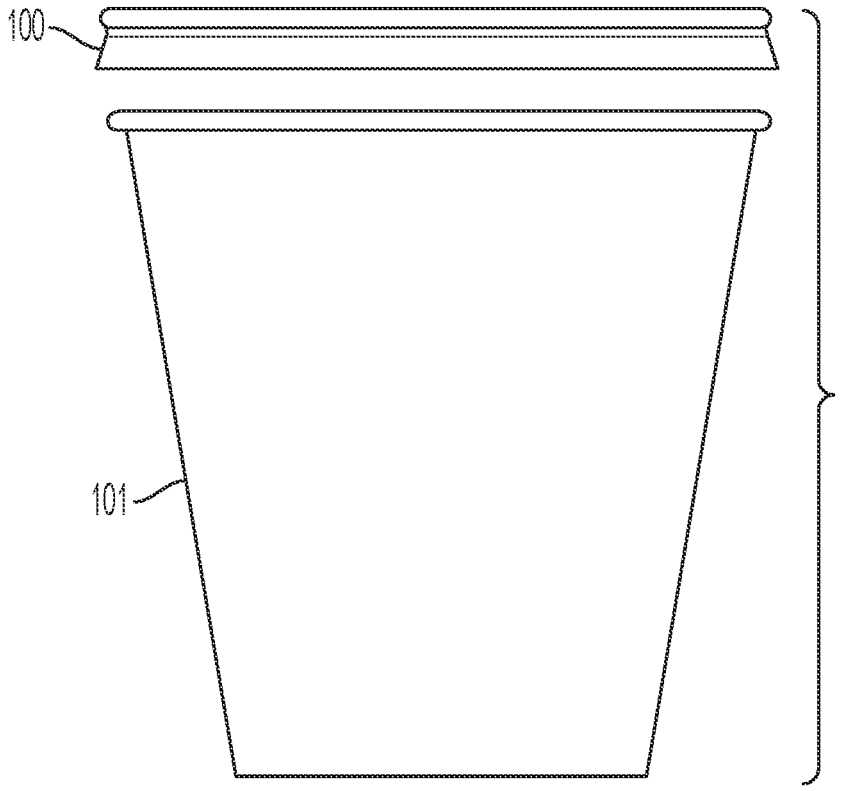
FIG. 1 illustrates a lid and a cup, according to an example embodiment.

FIG. 1 illustrates a lid 100 (or a closure 100 or an apparatus 100) and a cup 101, according to an example embodiment. Although depicted as a lid for a cup, the lid 100 can be considered a removable closure for a container, such as a top, a cover, or a cap. Similarly, while depicted as a cup, the cup 101 can be considered a container, such as a bucket, a can, a bottle, a bowl, etc., in addition to being the cup 101. The lid 100 is removably couplable to the cup 101. For example, in other embodiments, the cup 101 may take the form of another container, such as a bottle, canister, or other vessel configured to be part of another system, such as a vacuum cleaning device. Moreover, the lid 100 can be removably coupled to a top or top edge of the cup 101. The lid 100 may be attached to the top of the cup 101 in order to prevent the contents of the cup 101 from spilling as well as maintaining a temperature of the contents of the cup 101. The lid 100 may include a variety of features, such as a tab, locking features, a flange portion opposite the tab, a hinge that allows relative movement between the tab and the rest of the lid 100, among other components.

Additionally, while described as a lid, top, cover, or closure for a container, canister, or vessel, the machining processes of forming, trimming, and widening as described herein are pertinent in other applications and industries besides lids for cups. The machining processes described are also useful to create components for other systems where the component requires a locking or otherwise dampened tab within another planar or generally surface. For example, applications that involves some type of fluid and/or air flow, such as suctioning or pouring are also within the scope of the invention.

The lid 100 may be constructed from a thermoformable plastic. For example, the lid 100 may be formed from heating a sheet of plastic to a temperature such that the plastic is pliable, and then formed on one or more molds. The plastic forms around various shaping and designs on the mold(s). The formed lid 100 may be cut from the plastic sheet or extraneous plastic may be cut away from the lid 100 such that lid 100 takes a final formed shape or design. After being molded, the lid 100 may be considered to be in a formed condition. The cup 101 may be constructed from a variety of materials known to a person of skill in the art.

Figure 2:
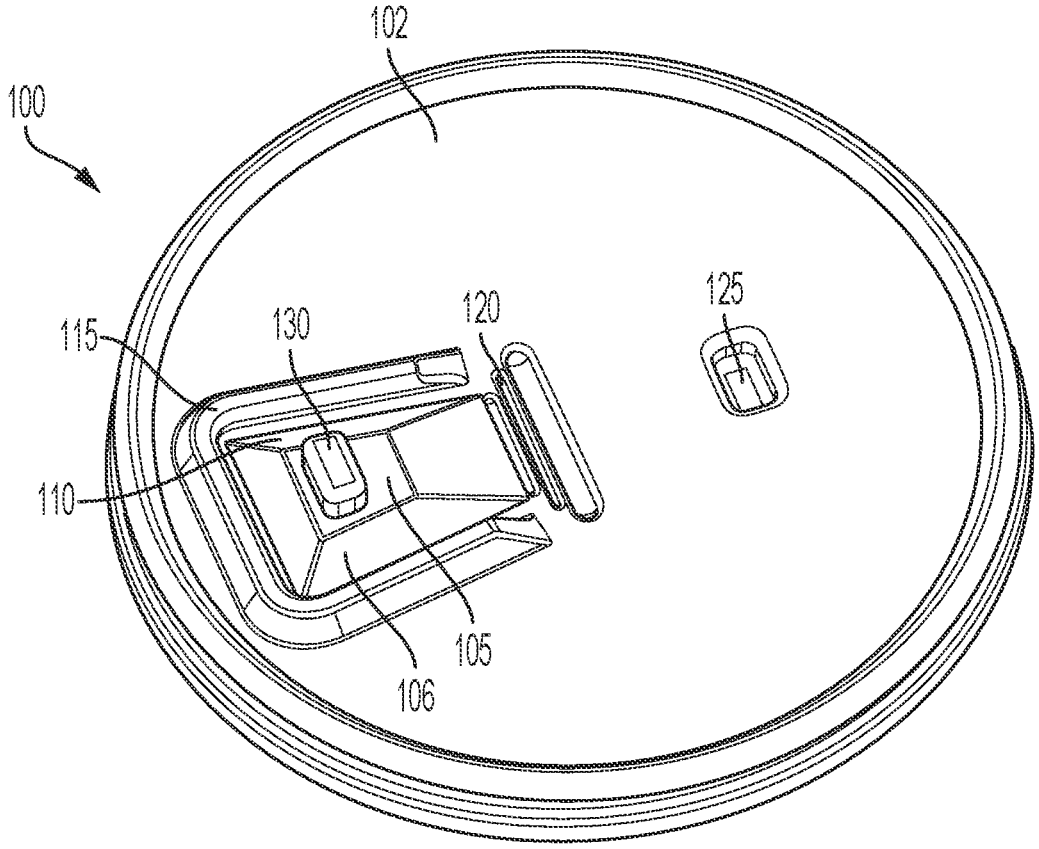
FIG. 2 illustrates a thermoformed lid, according to an example embodiment.
Figure 3:
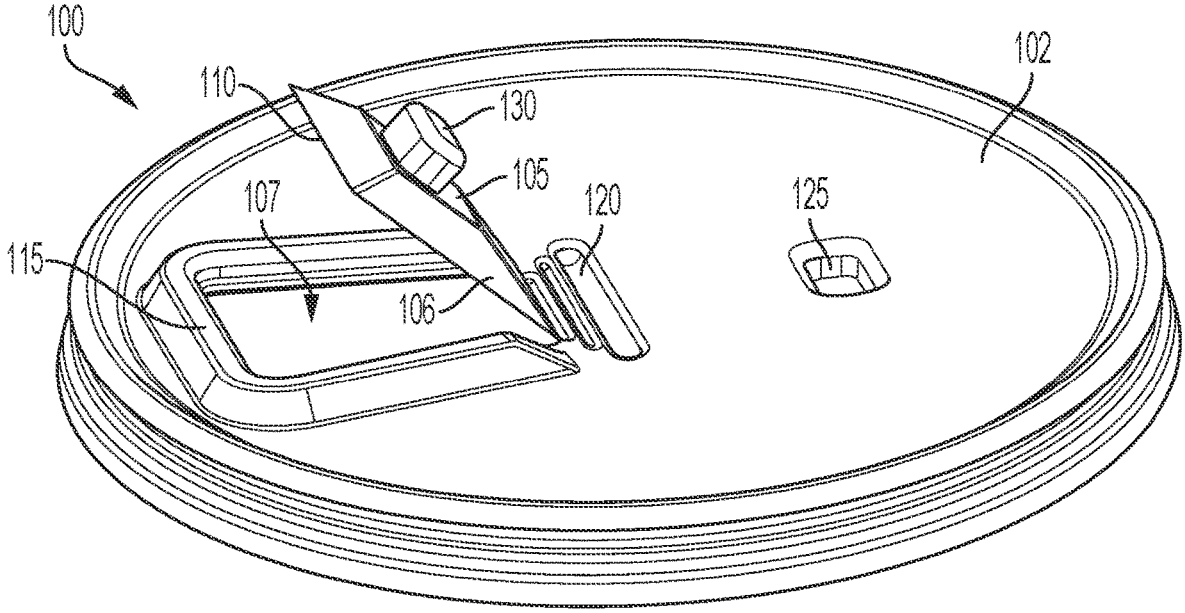
FIG. 3 illustrates a lid including a trimmed tab, according to an example embodiment.
Figure 4:
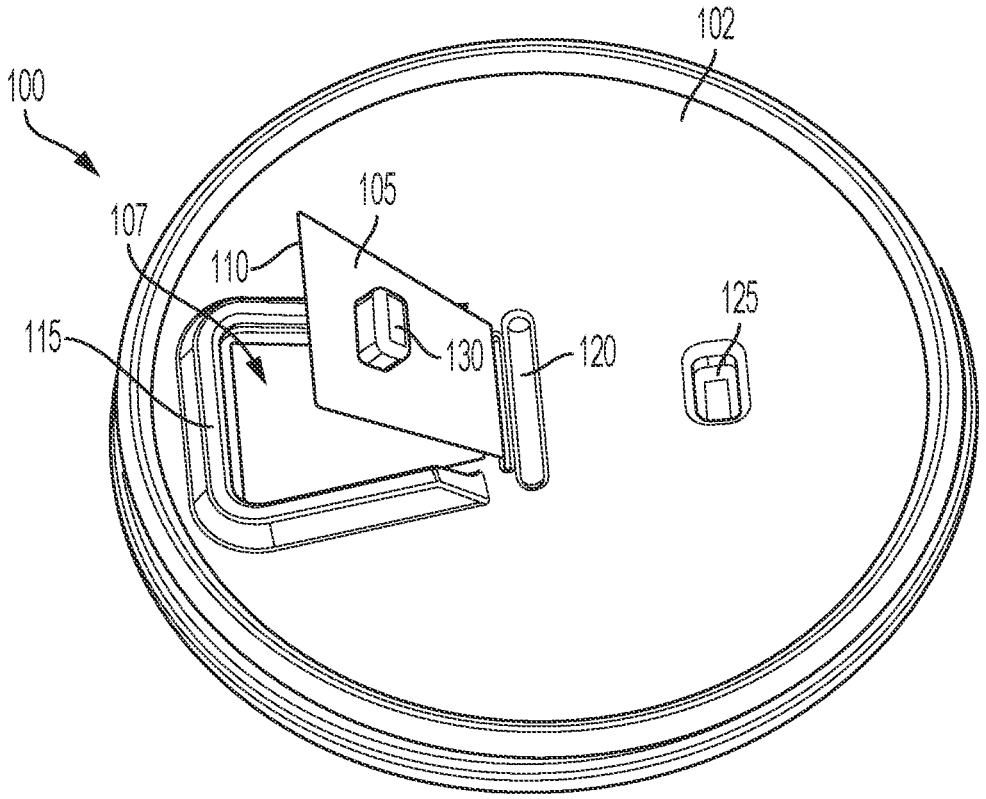
FIG. 4 illustrates a lid including a flattened tab, according to an example embodiment.
Figure 5:
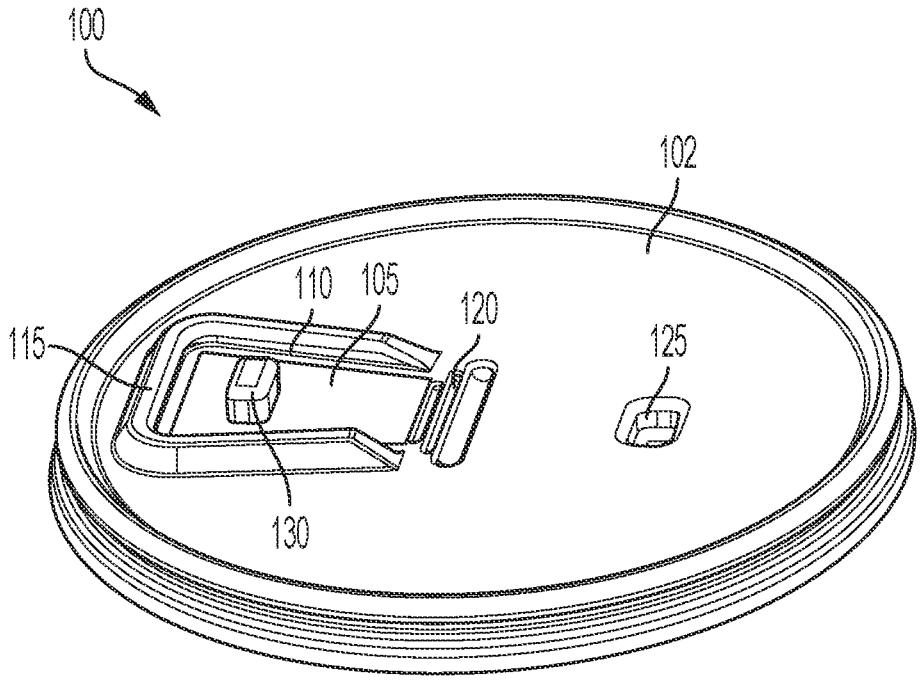
FIG. 5 illustrates a lid with a flattened tab in a closed position, according to an example embodiment.

FIG. 2, FIG. 3, FIG. 4, and FIG. 5 illustrate an embodiment of the lid 100. As shown these figures, the lid 100 includes a body portion 102, a tab 105, a flange portion 115, a hinge 120, a first locking feature 125, and a second locking feature 130. The tab 105 includes a plurality of edges 110, a middle body portion, a plurality of angled surfaces 106, and the second locking feature 130. The first locking feature 125 is part of the body portion 102 of the lid 100. The lid 100 also includes a cavity 107. FIG. 2 and FIG. 3 depict the lid 100 in a first condition, while FIG. 4 and FIG. 5 depict the lid in a second condition. The first condition may be a formed condition, which may include the lid 100 as formed (e.g., FIG. 2) and after trimming of the tab 105 from the lid 100 (e.g., FIG. 3).

The lid 100 may be formed from a heating a thin sheet of plastic around a mold in order to form the shape of the lid 100. The mold may include features that give the lid 100 the various shapes that make up the various features of the lid 100. The lid 100 may be formed from a single mold at one time. The body portion 102 of the lid 100 may generally be planar and may also be circular. The body portion 102 also includes the first locking feature 125. As depicted in FIG. 2, the first locking feature 125 may be a recessed depression in the body portion 102 of the lid 100. In other embodiments, the first locking feature 125 may have another shape or design, such as an extruded portion configured to couple to another locking feature. In some embodiments, the tab 105, the flange portion 115, and the hinge 120 may also be considered part of the body portion 102 of the lid 100.

The tab 105 of the lid 100 is coupled to the body portion 102 via the hinge 120. As such, after the tab 105 is trimmed or otherwise disconnected from the flange portion 115 of the lid 110, the tab 105 may move relative the body portion 102 (and the rest of the lid 100) by flexing of the hinge 120. The tab 105 may be trimmed on at least one of a plurality of edges of the tab 105. In some examples, the tab 105 may be trimmed on two edges, while in others the tab 105 may be trimmed on three edges. Another feature may include that the tab 105 is trimmed on all edges besides an edge that couples to and/or abuts the hinge 120. In addition to the plurality of edges, the tab also includes the second locking feature 130. In some examples, the second locking feature 130 may be part of the middle body portion of the tab 105. The second locking feature 130 may be an extrusion from the lid 100 and/or the tab 105 and be configured to mate with the first locking feature 125. As such, the tab 105 may be in an open position when the first locking feature 125 is coupled to the second locking feature 130.

The hinge 120 may take a variety of forms, including, e.g. "Z," "W," and "V" groove style hinges. The type of hinge may depend on a desired amount of tension in the hinge, or "hinge tension." Hinge tension may be increased with the addition of rib features to produce a stiffer hinge or increased tension hinge. Tensioning the hinge 120 may assist in maintaining the tab 105 in a closed position (see FIG. 5, below). The hinge 120 provides an area of the lid 100 to flex and bend, but may also bias the tab 105 in the closed position.

As shown in FIGS. 2 and 3, when in the first condition (i.e., before any tooling or post-form heating), the tab 105 includes the middle body portion (also 105 in the first condition) and the plurality of angled surfaces 106. The plurality of angled surfaces 106 may have an initial slope (or slopes) relative to the middle body portion of the tab 105 and relative to the body 102 of the lid 100. As described in more detail below, the slope (or slopes) of the plurality of angled surfaces 106 may be adjusted by heating and/or flattening such that the tab 105 is widened in a lateral direction, or in a direct generally parallel to the plane of the body 102 of the lid 100.

As depicted, the flange portion 115 may include the area of the lid 100 immediately around the tab 105. Edges and other features of the flange portion 115 may abut the plurality of edges 110 of the tab 105 when in the first condition. In some examples, such as those in FIGS. 2-5, the flange portion 115 may be extruded vertically to create a lip type shape. Moreover, a surface of the flange portion 115 may be rounded, which may provide comfort and safety to users of the lid 100. When in the first condition, the plurality of edges 110 of the tab 105 may pass through the flange portion 115 without interference, or in other words, without coming into contact with one another when the tab moves from the closed position to the open position (or the opposite, for example). However, when the tab 105 is the second condition (again, as described more below), at least one of the plurality of edges 110 of the tab 105 may overlap the flange portion 115 and thereby come into contact with the flange portion 115, and thus interfere with the movement of the tab 105 from one position to another position. Within examples, the flange portion 115 may be considered the lip portion and/or the edge of the cavity 107 of the lid 100. In other embodiments, the flange portion 115 may be considered the portion of the lid 100 immediately abutting the tab 105 before trimming the tab 105.

FIG. 3 depicts the lid 100 after trimming the tab 105 from the lid 100, and within examples, from the flange portion 115 of the lid 100. Trimming the tab 105 from the lid 100 may include trimming at least one of the edges of the tab 105 from the flange portion 115 of the lid 100. Trimming creates a separation between the tab 105 and the remainder of the lid 110, except for the hinge 120 where the tab 105 remains coupled to the lid 100. Trimming the tab 105 provides a location for liquid (or other contents) to be transferred through the lid 100. Trimming includes punching, cutting, using cylinders or mechanical rocking levels, and other known manufacturing methods.

As mentioned above, FIG. 4 and FIG. 5 depict the tab 105 in the second condition. In the second condition, the tab 105 has been widened such that the tab 105 takes up more lateral space (relative to the body 102 of the lid 100) than when in the first condition. In some examples, each of the plurality of angled surfaces 106 of the tab 105 are less sloped (i.e., closer to being planar with the body 102 of the lid 100), than in the first condition. As such, those angled surfaces 106 extend farther in a lateral direction (relative to a vertical axis perpendicular to the plane of the body 102, for example) than when in the first condition. Adjusting the slope of the angled surfaces 106 of the tab 105 may be considered widening the tab 105 in some examples. The amount of adjustment to the slope is based on creating a desired amount of interference between the flange portion 115 and the tab 105. In some examples, the tab 105 may become completely flattened such that the entire tab 105 is planar with the middle body portion of the tab 105. In other examples, complete flattening may not be required.

The widening process may be completed by flattening using tools and/or heating. In some examples, the widening process may include heating and thinning the tab 105 such that in the second condition the tab 105 is generally wider in a lateral direction. In such an example, the tab 105 may not have included angled surfaces, but may have been formed slightly thicker in preparation for later heating and thinning. Moreover, while widening of the tab 105 is generally discussed herein, similarly processes may be applied to the flange portion 115 of the lid 100 to create a similar effect. For example, the flange portion 115 may be extended into the space of the cavity 107 such that the cavity 107 is narrowed in the second condition. In such an example, even though the tab 105 may not be tooled after forming, from narrowing the cavity (or widening the flange portion 115 depending on the perspective), the flange portion 115 and the tab 105 may still interfere with one another nonetheless.

Within examples, the second condition where the tab 105 has been trimmed and widened, may be a result of a variety of tooling processes. Such processes may involve a single step and a single machine or tool, or multiple steps involving one or more machines or tools. In general, tooling involves a mechanized process. For example, the widening process may involve a coining, stamping, or clamping process in which the tab 105 is generally wider than it was in the formed or first condition. Widening the tab 105 may also include flexing or thinning the tab, in addition to flattening or otherwise altering the dimensions of the tab 105 such that there is interference between the tab 105 and the flange portion 115.

In some examples, the forming, trimming, and widening processes may occur with one or more machines and machine processes. Additionally, while discussed for example about a single lid 101, it should be understood that an advantage of the invention is that the machining described can be efficiently iterated in order to increase the scale and volume of production available.

FIG. 4 depicts the tab 105 having been widened by being completely flattened such that the plurality of angled surfaces 106 are now co-planar with the middle body portion of the tab 105. In this second condition, the plurality of edges 110 of the tab 105 may come into contact with one or more surfaces of the flange portion 115. In some examples, the flange portion 115 may overlap the plurality of edges 110 when the tab 105 is in the closed position, and as such, the tab 105 may be maintained in the closed position by the flange portion 115 (see FIGS. 6A and 6B, for example). In other examples, the flange portion 115 may overlap with the plurality of edges 110 of the tab 105 such that the tab 105 is limited or prevented from passing through the cavity 107.

For example, FIG. 5 depicts the lid 100 and tab 105 in the closed position after widening the tab 105. As shown, the tab 105, and more particularly, edges 110 of the tab 105 may be resting on a flat, inner surface of the flange portion 115, thereby preventing the tab 105 from entering the cavity 107 in a downward direction (for example). At the same time, an upper section or angled surface of the flange portion 115 may maintain the tab 105 in the closed position by interfering with the ability of the tab 105 to rotate and move towards the open position. As such, it may take an increased amount of force to push the tab 105 through the flange portion 115 such that the tab 105 is opened completely (or in the open position). Additionally, the tab may be in a partially open position or a partially closed position when the tab 105 is between the open position and the closed position.

Figure 6A:
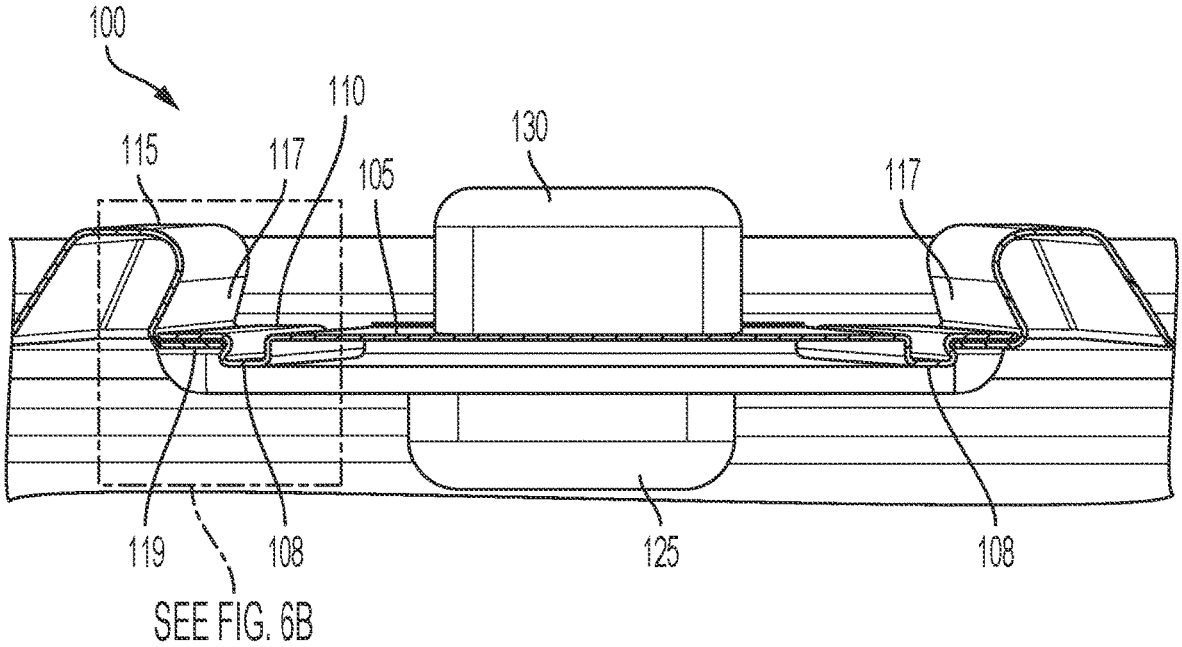
FIG. 6A illustrates a lid with a tab in a closed position, according to an example embodiment.
Figure 6B:
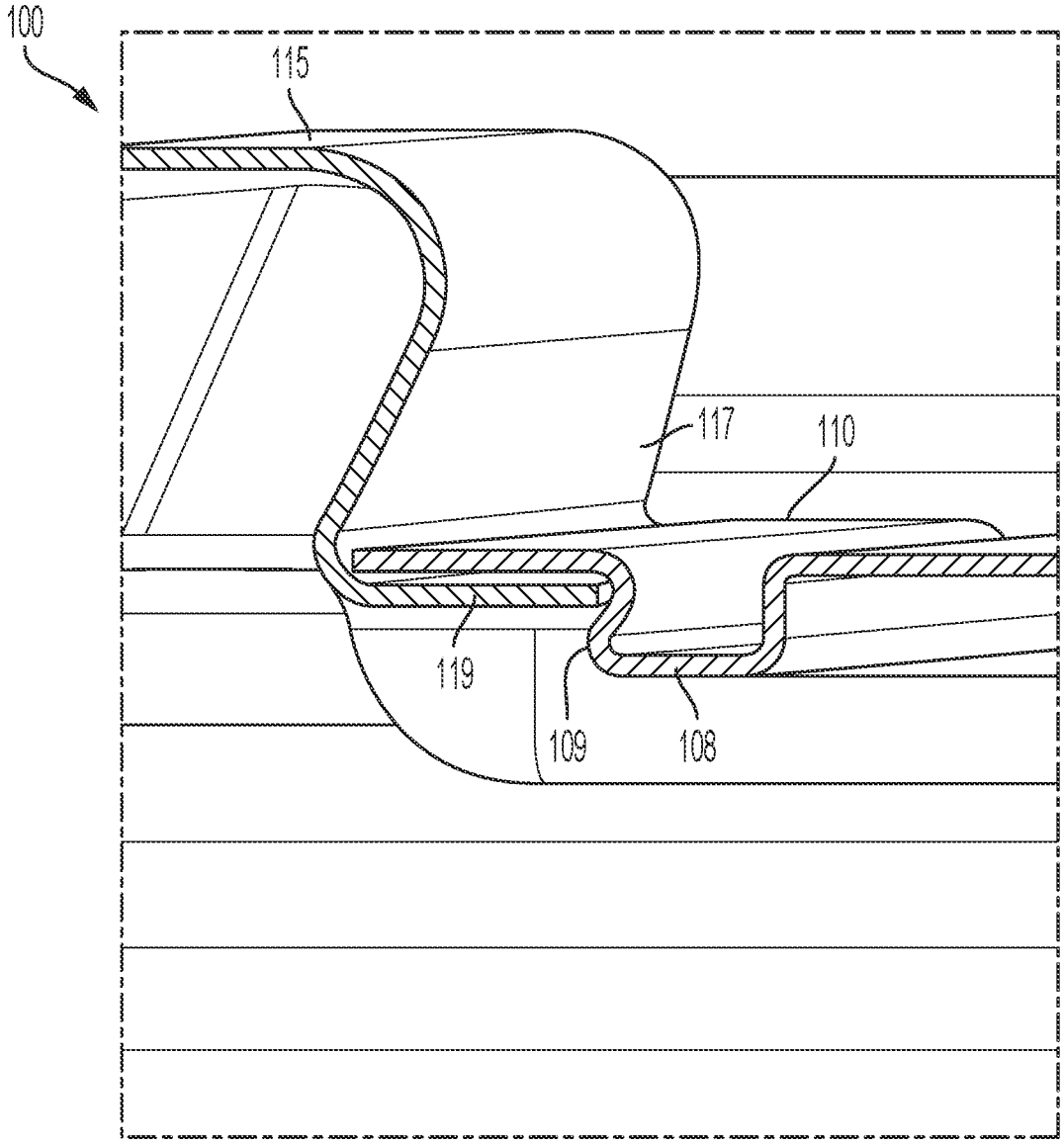
FIG. 6B illustrates a lid with a tab in a closed position, according to an example embodiment.

FIGS. 6A and 6B further illustrate how the flange portion 115 and the tab 105 interact and the interference between the flange portion 115 and the tab 105 when the tab 105 is in the second condition, according to some embodiments. FIG. 6A is a cross-section of the lid 100 when the tab 105 and the lid 100 are in the closed position. FIG. 6B is a closer view of the interferences created by widening the tab 105 (or again, narrowing the cavity 107 and widening the flange portion 115 in other examples).

As depicted in FIGS. 6A and 6B, the tab 105 and the flange portion 115 may include additional features. For example, as shown in FIGS. 6A and 6B, the tab 105 includes a channel 108 and an interference surface 109. Moreover, the flange portion 115 includes an angled surface 117 and a flat surface 119. In some examples, the flat surface 119 may be positioned around the cavity of the lid 100, and may be considered an inner flat surface. In some regards, the flange portion 115 may be considered to be positioned around a cavity of the lid 100. For example, the flange portion 115 may be positioned around three sides of the cavity, among other examples. The flat surface 119 may be within (or closer to the cavity) the angled surface 117, in some embodiments.

As shown, particularly, in FIG. 6B, the widening of the tab 105 in the second condition may create multiple areas of interference. For example, if moving the tab 105 about the hinge 120 (not shown in FIG. 6B) towards the open position, at least one of the edges 110 of the tab 105 would come into contact with the angled surface 117 of the flange portion 115, thereby limiting the ability of the tab 105 to freely move through the flange portion 115 towards the open position. However, the interference would not prevent the tab 105 from moving to the open position if enough force was applied. Relatedly, again if the tab 105 was moved from the closed position towards the open position, the interference surface 109 created by the channel 108 formed in the tab 105 would come into contact with at least a bottom of the flat surface 119 of the flange portion 115. Again, this interference would not prevent the tab 105 from moving to the open position if enough force was applied, but does interfere with the movement of the tab 105.

If the tab 105 was being moved from the open position towards the closed position, there would be other interferences. For example, first, the edge 110 of the tab 105 would come into contact with the rounded upper portion of the flange portion 115 above the angled surface 117. Then, once through that portion of the flanged portion 115, the interference surface 109 of the channel 108 of the tab 105 may come into contact with an edge of the flat surface 119 of the flange portion 115. By applying enough force the tab 105 may become removably locked or restrained into the closed position as shown in FIG. 6B. As depicted, in this embodiment, when in the closed position, the edge 110 of the tab 105 may be between two features of the flange portion 115, namely the angled surface 117 and the flat surface 119. Similarly, when in the closed position, at least a portion of the flat portion 119 of the flange portion 115 may be between a bottom surface of the edge 110 of the tab 105 and the interference surface 109 of the tab 105.

Moreover, the edge 110 of the tab 105 may contact the flat surface 119 of the flanged portion 115 in the closed position. Within examples, the flat surface 119 may prevent the tab 105 from moving through the cavity 107 because the plurality of edges 110 abut the flat surface 119 when in the closed position.

Figure 7A:
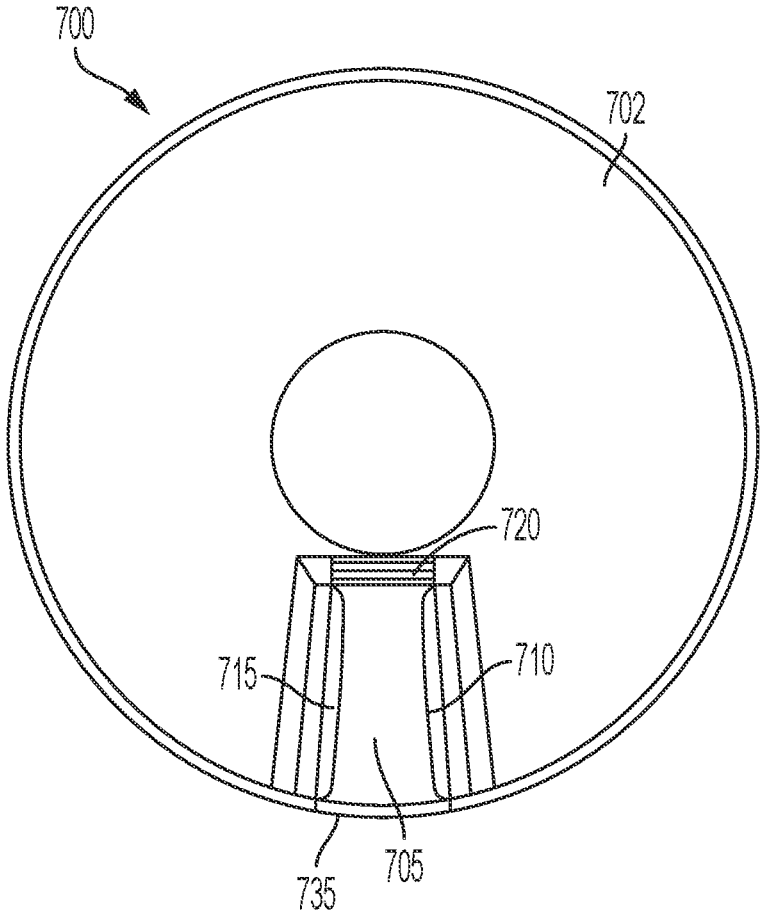
FIG. 7A illustrates a lid with a tab in a closed position, according to an example embodiment.
Figure 7B:
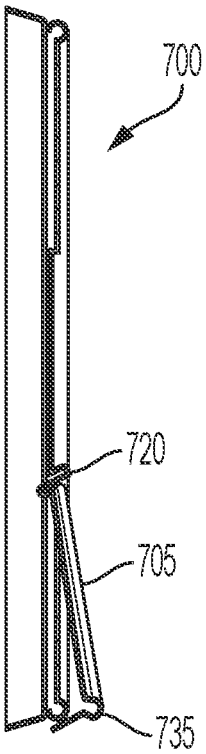
FIG. 7B illustrates a lid with a tab in a partially open position, according to an example embodiment.

Continuing, further embodiments may include other aspects as described herein. For example, FIG. 7A and FIG. 7B depict an embodiment of a lid 700. The lid 700 may include similar components and features as the lid 100 of FIGS. 1-6B; but the lid 700 may include other features fully separable but also combinable with features of the lid 100.

The lid 700 includes a body portion 702, a tab 705, a plurality of edges 710 of the tab 705, a flange portion 115, and a hinge 720. Moreover, the tab 705 of the lid 700 may include a tab flange 735 as shown in FIGS. 7A and 7B. The tab flange 735 is couplable to an edge of a cup (e.g., the cup 101 of FIG. 1). In such an embodiment, the flange portion 715 of the lid 700 may be on two sides of the tab 705, and the tab 705 may be considered to extend radially to an edge of the lid 700. The tab flange 735 may clip or otherwise be able to attach to or rest on the edge of a cup in order to maintain the lid 700 in a closed state. In this embodiment as well, at least one edge of the plurality of edges 710 may come into contact with the flange portion 715. For example, the flange portion 715 may assist in limiting the potential for the tab 705 to pass through a cavity of the lid 700. Again, such interference may come about from widening the tab 705 and/or widening the flange portion 715 of the lid 700. Although not depicted, the lid 700 may include other features, such as locking features as described herein. In FIG. 7B, the tab 705 is partially open as the hinge 720 flexes and the tab flange 735 is depicted away from an edge of a cup.

Figure 8A:
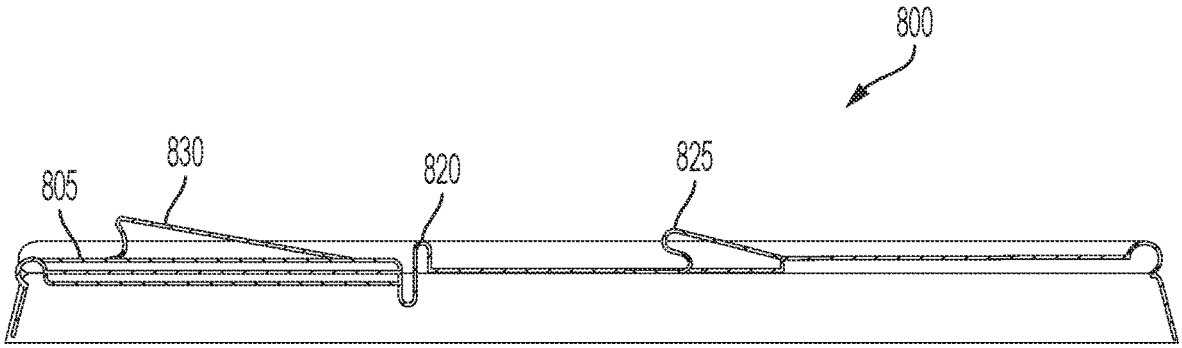
FIG. 8A illustrates a lid with locking features, according to an example embodiment.
Figure 8B:
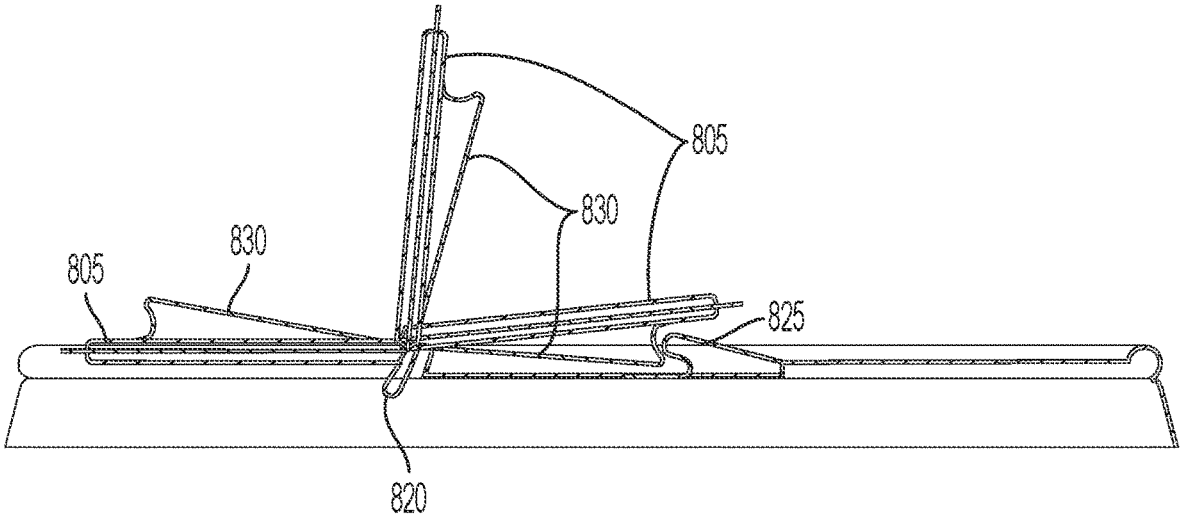
FIG. 8B illustrates a lid with locking features, according to an example embodiment.

FIGS. 8A and 8B highlight alternative locking features, according to example embodiments. FIGS. 8A and 8B include a lid 800, a tab 805, a hinge 820, a first locking feature 825, and a second locking feature 830. Again, as before, the lid 800 may include similar components as described in FIGS. 1-7B, but also may include other aspects. As depicted in FIGS. 8A and 8B, the first locking feature 825 and the second locking feature 830 may include corresponding rounded interlocking tab features. As depicted in FIG. 8B, the first locking feature 825 and the second locking feature 830 may couple together when the tab 805 is in the open position. The coupled locking features may maintain the tab 805 in the open position so that a user may easily drink or pour the liquid without the tab 805 flapping or freely moving around while the user drinks or pours, for example.

Continuing still, FIGS. 9A, 9B, 10A, and 10B depict other embodiments of flange portions and profiles of the tab and flange interferences.

Figure 9A:
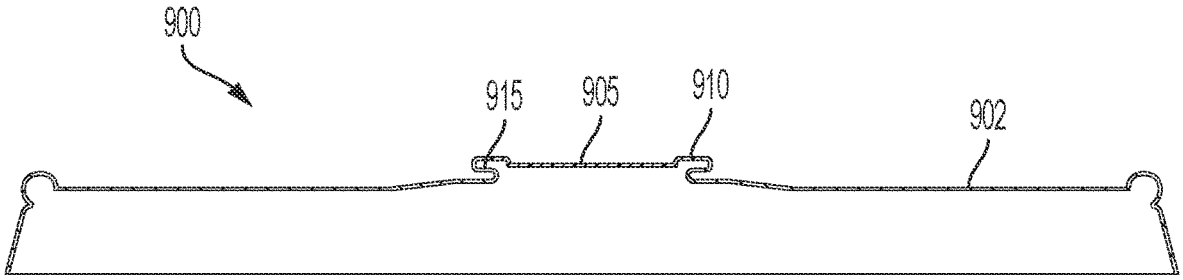
FIG. 9A illustrates a lid with a tab in a formed condition, according to an example embodiment.
Figure 9B:
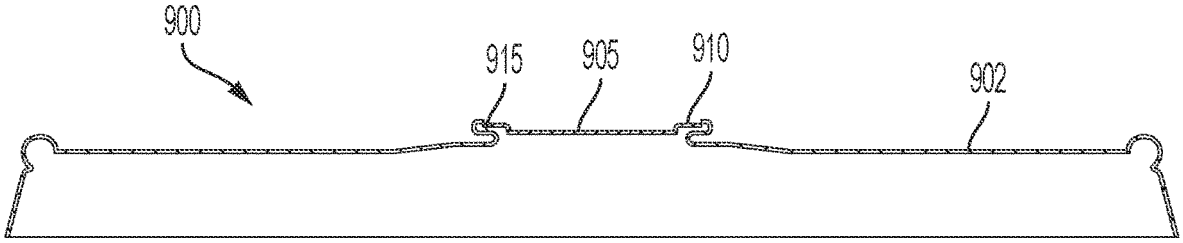
FIG. 9B illustrates a lid with a tab in a trimmed condition, according to an example embodiment.

FIGS. 9A and 9B depict lid 900 with a body portion 902, a tab 905, edges 910 of the tab 905, and a flange portion 915 of the lid 900. FIG. 9A shows the tab 905 in a first condition as formed. For clarity, tab 905 is hashed differently to see how it is positioned different when in the first condition and when in a trimmed condition. The tab 905 may be trimmed from the flange portion 915 and be wider than an inner section of the flange portion 915. As such, edges 910 of the tab 905 may rest within rounded edges of the flange portion 915 as depicted in FIG. 9B after being trimmed. As such, in FIGS. 9A and 9B the flange portion 915, positioned around a cavity of the lid 900, may have a different profile or shape than other flange portions of other embodiments.

Figure 10A:
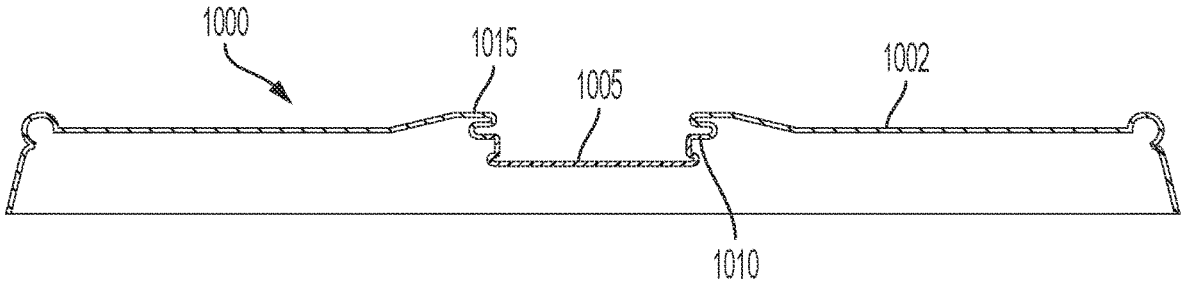
FIG. 10A illustrates a lid with a tab in a formed condition, according to an example embodiment.
Figure 10B:
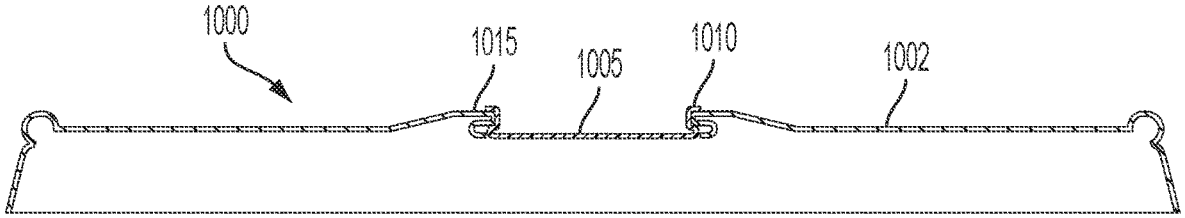
FIG. 10B illustrates a lid with a tab in a trimmed condition, according to an example embodiment.

Similarly, FIGS. 10A and 10B illustrate yet another flange portion and corresponding tab profile. FIGS. 10A and 10B include a lid 1000, a body portion 1002, a tab 1005, edges 1010 of the tab 1005, and a flange portion 1015. FIG. 10A depicts the lid 1000 in a formed condition, before trimming, while FIG. 10B depicts the tab 1005 of the lid 1000 after being trimmed. Again, the edges 1010 of the tab 1005 are rounded in this example, but also provide interference between the edges 1010 and the flange portion 1015 in order to support the tab 1005 in a closed position.

Figure 11:
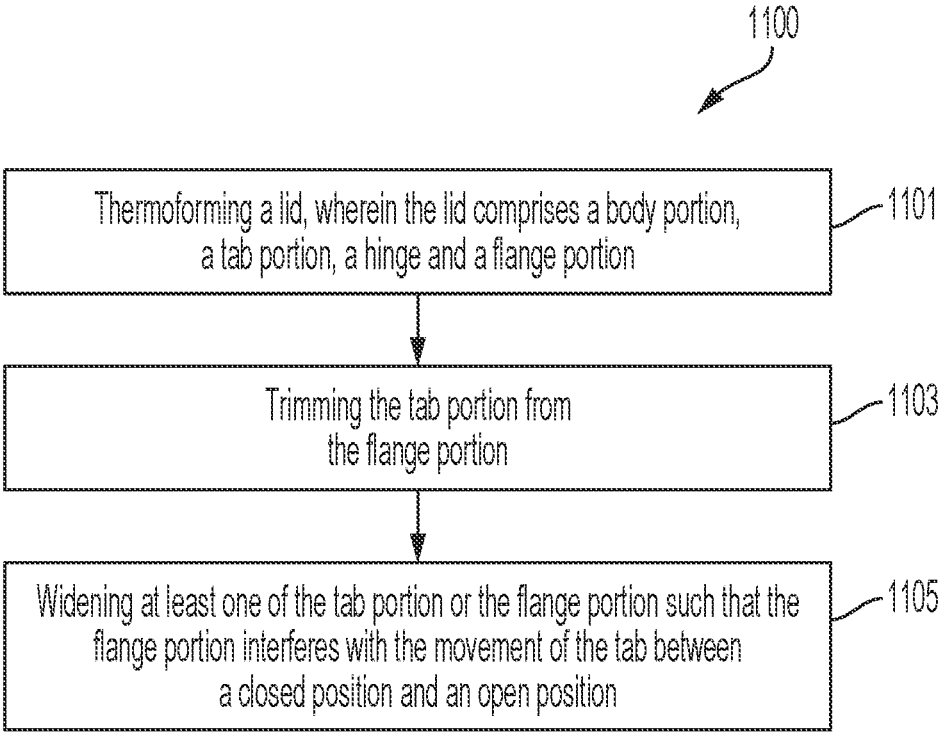
FIG. 11 is a block diagram of an example method, according to an example embodiment.

FIG. 11 is a block diagram of an example method 1100, according to an example embodiment. Method 1100 includes thermoforming a lid at block 1101. The lid includes at least a body portion, a tab portion, a hinge, and a flange portion. The hinge may be similar to hinge 120 (for example), and be between the tab portion and the body portion of the lid. Thermoforming the lid may include heating plastic and applying a mold in order to define various features of the lid in a single operation.

Method 1100 also includes trimming the tab portion from the flange portion at block 1103. Trimming the tab portion may include trimming at least one edge of the tab portion from a flange portion. The flange portion may be considered to surround the tab portion on at least two or three sides. In some embodiments, the flange portion may be positioned around the tab portion on each side of the tab portion except for where the hinge is coupled to the tab portion. As such, the tab portion is able to move relative to the body portion via the hinge.

Method 1100 also includes widening at least one of the tab portion or the flange portion at block 1105. The widening occurs after the tab portion was trimmed as described in block 1103. Widening at least one of the tab portion or the flange portion includes widening either component such that the flange portion interferes with the movement of the tab portion when the tab portion moves from a closed position to an open position.

Within other examples, widening the tab portion includes heating, coining, stamping, thinning, flexing, and/or flattening the tab portion of the lid, among other possible machining processes. Similarly, widening the flange portion may include heating, thinning, and/or flattening the flange portion of the lid. In some examples, widening the tab portion may include adjusting a slope of at least one of a plurality of angled surfaces of the tab portion. The angled surfaces may have a greater slope in a first condition than in a second condition in such an example. Among other examples, before the widening of the tab portion, the tab portion may freely pass through the flange portion. However, after widening the tab portion, the flange portion interferes with the movement of the tab portion, such as movement from one position to another position.

CONCLUSION

The present disclosure is not to be limited in terms of the particular implementations described in this application, which are intended as illustrations of various aspects. Many modifications and variations can be made without departing from its scope, as will be apparent to those skilled in the art. Functionally equivalent methods and apparatuses within the scope of the disclosure, in addition to those enumerated herein, will be apparent to those skilled in the art from the foregoing descriptions. Such modifications and variations are intended to fall within the scope of the appended claims.

The above detailed description describes various features and functions of the disclosed systems, devices, and methods with reference to the accompanying figures. The example implementations described herein and in the figures are not meant to be limiting. Other implementations can be utilized, and other changes can be made, without departing from the scope of the subject matter presented herein. It will be readily understood that the aspects of the present disclosure, as generally described herein, and illustrated in the figures, can be arranged, substituted, combined, separated, and designed in a wide variety of different configurations, all of which are explicitly contemplated herein.

We claim:

1. An apparatus, comprising:

a body portion; and a tab coupled to the body portion via a hinge, wherein the tab comprises a first side edge, a second side edge, and a third edge opposite the hinge and extending between the first side edge and the second side edge, wherein the tab has at least a closed position covering an opening in the body portion and an open position where the opening in the body portion is uncovered, and wherein the third edge extends towards, but short of, a perimeter of the body portion when the tab is in the closed position, wherein:

in a first condition the tab from the first side edge to the second side edge has a first width, when the tab is in a second condition, the tab from the first side edge to the second side edge has been widened to a second width greater than the first width to provide a widened tab when the tab is in the second condition, the first side edge, the second side edge, and the third edge of the tab are positioned away from the perimeter of the body portion, a flat surface is positioned around the opening in the body portion, and when the tab is in the second condition and is in the closed position, the first side edge, the second side edge, and the third edge extend over the flat surface.

2. The apparatus of claim 1, wherein:

the body portion comprises a first locking feature, the tab comprises a second locking feature, and when the tab is in the open position the second locking feature is coupled to the first locking feature.

3. The apparatus of claim 1, wherein when the tab is in the first condition, the tab comprises a plurality of angled surfaces that are sloped relative to a middle body portion of the tab.

4. The apparatus of claim 3, wherein when the tab is in the second condition, each of the plurality of angled surfaces of the tab are less sloped relative the body portion of the tab than when in the first condition.

5. The apparatus of claim 3, wherein when the tab is in the second condition, each of the plurality of angled surfaces are planar with the body portion.

6. The apparatus of claim 1, wherein when the tab is in the second condition, the tab is primarily flat.

7. The apparatus of claim 1, further including:

a raised flange portion extending upwardly from the body portion, wherein:

when the tab is in a first condition, the first and second side edges of the tab are movable from the closed position to the open position without interference with the raised flange portion, and when the tab is in a second condition, the tab has been widened to the second width such that the first and second side edges of the tab overlap the raised flange portion and the raised flange portion interferes with a movement of the tab from the closed position to the open position.

8. The apparatus of claim 7, wherein the raised flange portion is positioned on the body portion entirely between the perimeter of the body portion.

9. The apparatus of claim 7, wherein the raised flange portion defines a cavity in the body portion.

10. The apparatus of claim 7, wherein an outer surface of the raised flange portion is rounded.

11. The apparatus of claim 1, wherein the hinge biases the tab towards the closed position.

12. The apparatus of claim 1, wherein the body portion and the tab are formed of a thermoformed material.

13. A method, comprising:

forming a closure, wherein:

the closure comprises a body portion and a tab coupled to the body portion via a hinge, the tab comprises a first side edge, a second side edge, and a third edge opposite the hinge and extending between the first side edge and the second side edge, the tab has at least a closed position covering an opening in the body portion and an open position where the opening in the body portion is uncovered, the third edge extends towards, but short of, a perimeter of the body portion when the tab is in the closed position, in a first condition the tab from the first side edge to the second side edge has a first width, when the tab is in a second condition, the tab from the first side edge to the second side edge has been widened to a second width greater than the first width, the first side edge, the second side edge, and the third edge of the tab are positioned away from the perimeter of the body portion, and a flat surface is positioned around the opening in the body portion;

trimming the tab from the body portion such that the tab is movable relative to the body portion via the hinge; and widening the tab such that when the tab is in the second condition, the first side edge, second side edge of the widened tab extend over the flat surface when the tab is in the closed position, wherein, when the tab is in the second condition and is in the closed position, the third edge extends over the flat surface.

14. The method of claim 13, wherein widening the tab comprises heating the tab of the closure.

15. The method of claim 13, wherein widening the tab comprises flattening the tab of the closure.

16. The method of claim 13, wherein widening the tab comprises adjusting a slope of at least one of a plurality of angled surfaces of the tab of the closure.

17. An apparatus comprising:

a lid positionable over an upper rim of a container, the lid having a body portion and a raised outer perimeter of the lid;

a tab coupled to the body portion of the lid via a hinge, wherein the tab comprises a first side edge, a second side edge, and a third edge opposite the hinge and extending between the first side edge and the second side edge, wherein the tab has at least a closed position covering an opening in the body portion of the lid and an open position where the opening in the body portion of the lid is uncovered, and wherein the third edge extends towards, but short of, a perimeter of the body portion when the tab is in the closed position; and a raised flange portion including an inner flat surface and an angled surface extending upwardly from the inner flat surface, wherein:

the raised flange portion is positioned around three sides of the opening, the inner flat surface is positioned around and adjacent to the three sides of the opening, the first side edge, the second side edge, and the third edge of the tab extend over the inner flat surface when the tab is in the closed position, and a flat surface on the body portion is positioned between the raised outer perimeter of the lid and the raised flange portion positioned around the three sides of the opening.

18. The apparatus of claim 17, wherein at least one of the first and second side edges of the tab overlaps the raised flange portion such that the raised flange portion interferes with a movement of the tab from the closed position to the open position.

19. The apparatus of claim 1, wherein the body portion is circular.

20. The apparatus of claim 17, wherein:

the body portion comprises a first locking feature, the tab comprises a second locking feature, and when the tab is in the open position the second locking feature is coupled to the first locking feature.

* * * * *